US010471292B2

(12) United States Patent
Keough et al.

(10) Patent No.: US 10,471,292 B2
(45) Date of Patent: Nov. 12, 2019

(54) EXIT SPEED GENERATOR

(71) Applicant: EXIT SPEED INC., Mermaid (CA)

(72) Inventors: Brett Jeffery Lonny Keough, Mermaid (CA); Jeffery Reginald Leroy Ellsworth, Alberton (CA)

(73) Assignee: EXIT SPEED INC., Mermaid, Pei (CA)

( * ) Notice: Subject to any disclaimer, the term of this patent is extended or adjusted under 35 U.S.C. 154(b) by 0 days.

(21) Appl. No.: 15/856,668

(22) Filed: Dec. 28, 2017

(65) Prior Publication Data

US 2018/0280754 A1 Oct. 4, 2018

Related U.S. Application Data

(60) Provisional application No. 62/481,312, filed on Apr. 4, 2017.

(51) Int. Cl.
*A63B 69/00* (2006.01)
*A63B 21/055* (2006.01)
(Continued)

(52) U.S. Cl.
CPC ..... *A63B 21/0552* (2013.01); *A63B 21/0088* (2013.01); *A63B 21/151* (2013.01);
(Continued)

(58) Field of Classification Search
CPC . A63B 69/0002; A63B 59/50; A63B 69/3632; A63B 21/0088; A63B 57/60;
(Continued)

(56) References Cited

U.S. PATENT DOCUMENTS 3,416,803 A * 12/1968 Batista ..... A63B 69/3632 473/228
3,606,340 A * 9/1971 Tiller ..... A63B 69/3632 473/232

(Continued)

FOREIGN PATENT DOCUMENTS

CN 204972961 U 1/2016
JP 2005137396 A * 6/2005

OTHER PUBLICATIONS

Markwort Sporting Goods Company, "Power Fins TM", Markwort Catalogue, Oct. 30, 2016, p. b38. URL: http://www.markwort.com/pdfs/2017B/b38.pdf.

(Continued)

*Primary Examiner* — Mitra Aryanpour
(74) *Attorney, Agent, or Firm* — Perry + Currier Inc.

(57) ABSTRACT

A training apparatus for use with a bat is provided. The training apparatus has a fastening portion releasably securable to a barrel of the bat and a resistance portion attached to the fastening portion such that the resistance portion extends past a barrel end of the bat when the training apparatus is secured to the barrel. The resistance portion is a flexible material configured to add resistance throughout a bat swing, thus increasing the strength and torque of the athlete for that motion. The training apparatus can be used with the bat for training and released for normal bat use when not training, thus using the athletes regular bat for training.

8 Claims, 5 Drawing Sheets

(51) Int. Cl.

| | |
|---|---|
| ***A63B 21/00*** | (2006.01) |
| ***A63B 69/38*** | (2006.01) |
| ***A63B 69/36*** | (2006.01) |
| ***A63B 21/008*** | (2006.01) |
| ***A63B 60/00*** | (2015.01) |
| *A63B 15/00* | (2006.01) |
| *A63B 59/50* | (2015.01) |

(52) U.S. Cl.
CPC ..... *A63B 60/00* (2015.10); *A63B 69/0002* (2013.01); *A63B 69/36* (2013.01); *A63B 69/38* (2013.01); *A63B 15/00* (2013.01); *A63B 59/50* (2015.10); *A63B 2069/0008* (2013.01); *A63B 2225/09* (2013.01)

(58) Field of Classification Search
CPC ..... A63B 47/02; A63B 15/00; A63B 69/36; A63B 69/38; A63B 21/151; A63B 21/0552
USPC ..... 473/457, 437, 422, 451, 564, 567, 228, 473/226, 219; D21/789
See application file for complete search history.

(56) References Cited

U.S. PATENT DOCUMENTS

| | | | | |
|---|---|---|---|---|
| 3,809,397 | A | 5/1974 | Gruenewald | |
| 5,100,148 | A * | 3/1992 | Smith | A63B 15/00 473/228 |
| 5,165,683 | A * | 11/1992 | Beutler | A63B 15/00 434/252 |
| 5,207,625 | A * | 5/1993 | White | A63B 21/0088 473/228 |
| 5,394,914 | A * | 3/1995 | Meek | A63B 57/60 15/114 |
| 5,395,107 | A * | 3/1995 | De Pippo | A63B 21/0088 473/228 |
| 5,803,838 | A | 9/1998 | DeMarini et al. | |
| 5,980,397 | A * | 11/1999 | Hart | A63B 59/50 473/437 |
| 6,093,114 | A * | 7/2000 | Haringa | A63B 69/0002 473/329 |
| 6,533,685 | B1 * | 3/2003 | Otten | A63B 59/60 473/437 |
| 7,112,152 | B1 * | 9/2006 | Chen | A63B 21/0088 473/457 |
| 7,384,344 | B2 * | 6/2008 | Aguirre | A63B 15/00 473/219 |
| 8,556,755 | B1 | 10/2013 | Zackery | |
| 9,199,152 | B2 * | 12/2015 | Phillips | A63B 69/3632 473/219 |
| 9,539,482 | B2 | 1/2017 | Parnell | |
| 9,636,560 | B1 | 5/2017 | Celone et al. | |
| 2008/0261729 | A1 * | 10/2008 | Mullin | A63B 47/02 473/457 |
| 2016/0074728 | A1 | 3/2016 | Arzola et al. | |

OTHER PUBLICATIONS

Huff, Scott, "baseball powerchute 042511.wmv", YouTube video, Aug. 30, 2011. URL: https://www.youtube.com/watch?v=LETfmaByz9E.

ISA/CA, International Search Report and Written Opinion, dated Apr. 24, 2018, re PCT International Patent Application No. PCT/IB2017/058479.

Chute Trainer, "Bat Chute by Chute Trainer", YouTube Video, Sep. 29, 2016. URL: https://www.youtube.com/watch?v=_jfiioUo-hE.

* cited by examiner

EXIT SPEED GENERATOR

CROSS-REFERENCE TO RELATED APPLICATIONS

This application claims priority from U.S. provisional patent application No. 62/481,312, filed Apr. 4, 2017, the content of which is incorporated herein by reference.

BACKGROUND

Various training equipment exists for swung devices, such as baseball bats, golf clubs and the like. For example, U.S. published patent application no. 2016/0074728 (Chute Trainer Inc.) describes a parachute-type apparatus attached to a device such as a golf club. The apparatus may, however, provide inconsistent resistance through a swing as a result of delay in opening of the parachute. Further, when applied to certain devices (e.g. baseball bats) the apparatus may lead to improper swing technique, for example causing an athlete to initially drop the bat barrel, and later upper cut the swing to get the parachute to cause drag.

Another example of training equipment includes a "donut" weight (i.e. a ring slid onto a bat for added weight). This device also provides resistance to a player's swing when the apparatus is attached to the bat. However, the resistance is not present in certain steps of the swing. Further, the added weight may pull the bat down towards the earth as opposed to pulling back against the stroke or swing.

SUMMARY

A training apparatus for use with a bat is provided. The training apparatus has a fastening portion releasably securable to a barrel of the bat; and a resistance portion comprising a flexible material configured to add resistance during a bat swing. The resistance portion is attached to the fastening portion such that the resistance portion extends past a barrel end of the bat when the training apparatus is secured to the barrel.

BRIEF DESCRIPTIONS OF THE DRAWINGS

Embodiments are described with reference to the following figures, in which.

DETAILED DESCRIPTION OF THE EMBODIMENTS

Sports equipment intended to be swung, such as baseball bats, golf clubs and the like, may benefit from training apparatus imposing resistance during the swing to increase the force required by a user to swing the equipment. In the case of a baseball bat, for example, a baseball swing can be broken down into 6 steps:

1) The Load: Store energy to release into the ball. The power of a baseball swing comes from the ground up, so weight is transferred to the back foot in anticipation of the pitch of the ball for release during the swing.

2) The Step: This is the transfer of the weight to the front foot, essentially projecting the stored energy and timing the action of the swing.

3) The Drive: This is where the stored energy becomes uncoiled into the swing. The knob of the bat is driven towards the ball in a pulling motion.

4) Contact: This is the point of the swing that makes contact with the ball.

5) Extend: The transfer of energy continues through the contact of the ball.

6) Extend again: Continuing the swing with power through the ball is very important to the distance and force it will be driven.

Conventional training apparatus used for swing training include a donut weight that slides on to the bat. The momentum of such a weight, however, carries the bat through steps 4-6 above from the centrifugal force created by setting the weighted bat in motion. As a result, resistance is not applied throughout the swing.

In fact, when weights are used for this purpose, the athlete is actually pulling in the opposite direction near the end of their swing in order to slow the bat down. This does not assist the athlete in developing their swing in steps 4 through 6 thus failing to maximize the exit speed of their swing.

Figure 1:
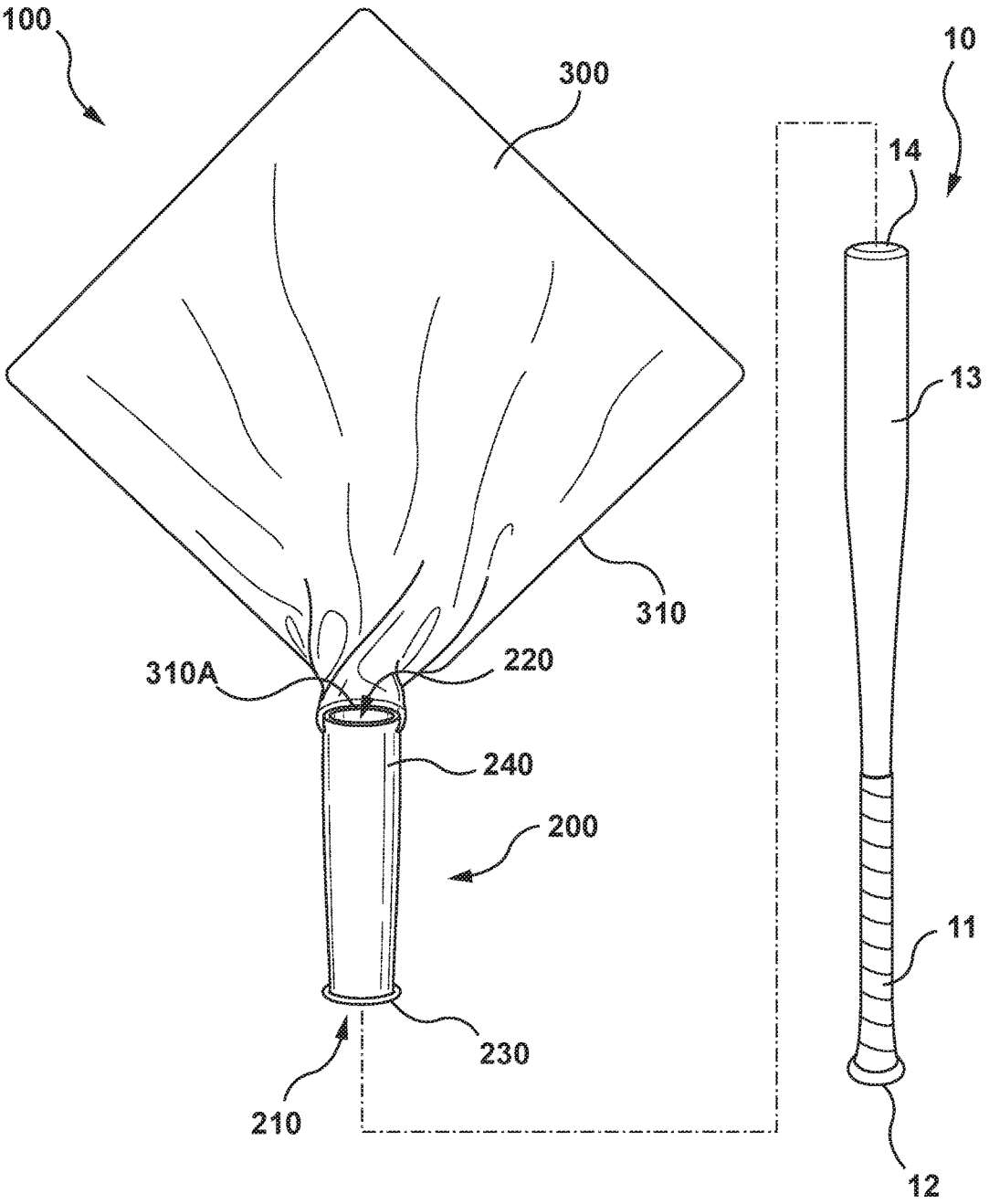
FIG. 1 depicts a training apparatus and a baseball bat, according to a non-limiting embodiment.

FIG. 1 depicts a training apparatus 100 and a baseball bat 10 according to a non-limiting embodiment. Other swinging apparatuses than the baseball bat 10, such as a tennis racket, a golf club and the like, are also contemplated for use with the training apparatus 100.

The baseball bat has a handle portion 11 terminating in a knob 12 and connected to a barrel 13 terminating in a barrel end 14. Generally, the handle portion 11 and the knob 12 have respective diameters smaller than a maximum diameter of the barrel 13. Further, the barrel 13 may be shaped such that the barrel 13 has a variable diameter. Specifically, the diameter of the barrel 13 generally tapers from the barrel end 14 to the handle portion 11 of the bat 10, with the maximum diameter of the barrel 13 proximal the barrel end 14.

The training apparatus 100 generally includes a fastening portion 200 and a resistance portion 300. The fastening portion 200 is configured to be releasably securable to the barrel 13 of the bat 10. The resistance portion 300 includes a member of flexible material attached to the fastening portion 200 and is configured to add resistance during a bat swing. The resistance portion 300 is further configured to extend past the barrel end 14 when the training apparatus 100 is secured to the barrel 13.

Figure 2:
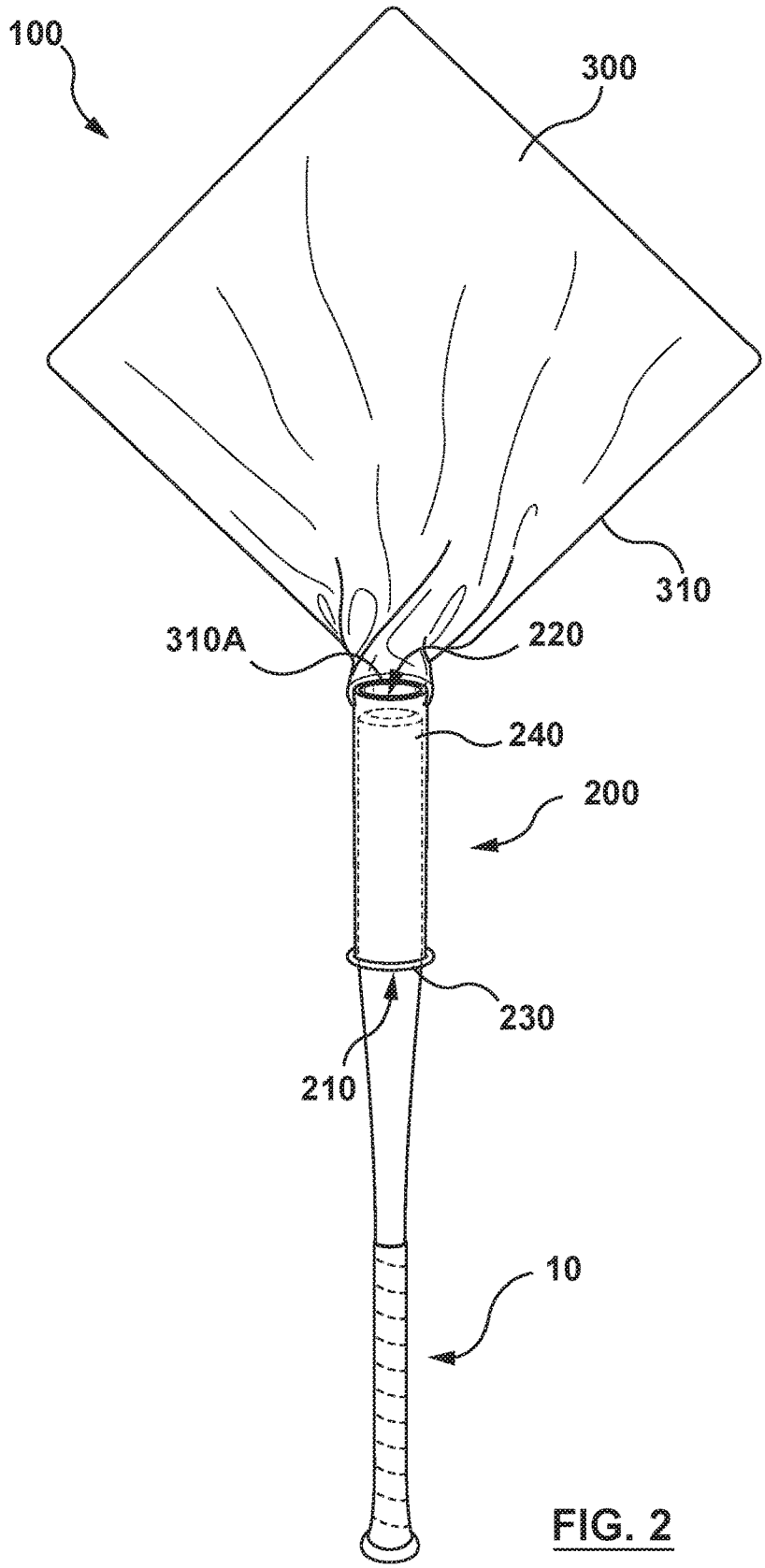
FIG. 2 depicts the training apparatus of FIG. 1 mounted on the bat, according to a non-limiting embodiment.

In some implementations, the fastening portion 200 may include a first opening 210 and a second opening 220. The first opening 210 has a diameter smaller than the maximum barrel diameter, while the second opening 220 has a diameter larger than the maximum barrel diameter. FIG. 2 depicts the training apparatus 100 mounted on the baseball bat 10. To secure the training apparatus 100 to the baseball bat 10, the fastening portion 200 receives the handle portion 11 through the second opening 220 and the first opening 210 such that the first opening 210 engages the barrel 13 adjacent to the handle portion 11, and the second opening 220 is located adjacent the barrel end 14 when the first opening 210 is engaged. The training apparatus 100 may be released by disengaging the first opening 210 from the barrel 13 (i.e. by sliding the apparatus 100 toward the knob 12) and removing the handle portion 11 from the first opening 210 and the second opening 220.

Returning to FIG. 1, the fastening portion 200 may include a ring 230 providing the first opening 210. The ring 230 may have an inner diameter smaller than the maximum barrel diameter to provide the first opening 210. In some implementations, the ring 230 may have an inner diameter of about two inches. Thus the ring 230 may accommodate most sizes of baseball bats 10 such that the handle portion 11 and the knob 12 fit through the ring 230, and the ring 230 engages the barrel 13 as the barrel diameter increases towards the barrel end 14. The ring 230 may comprise combinations of metals, and plastics. Alternately, the ring 230 may be formed from fabric, such as nylon, polyester, neoprene, or other suitable materials to provide the first opening 210 for engaging the barrel 13 to secure the training apparatus 100 to the bat 10.

In some implementations, the ring 230 may further include an anti-slip material covering at least a portion of the ring 230, the anti-slip material configured to limit rotational movement of the bat within the ring. For example, the anti-slip material may cover an inner portion of the ring 230, where the ring 230 engages the baseball bat 10. In other examples, the ring 230 may be wrapped in the anti-slip material. The anti-slip material may comprise nylon, rubber, or another suitable material configured to grip the bat to limit rotational movement of the bat 10 within the ring 230.

Figure 3:
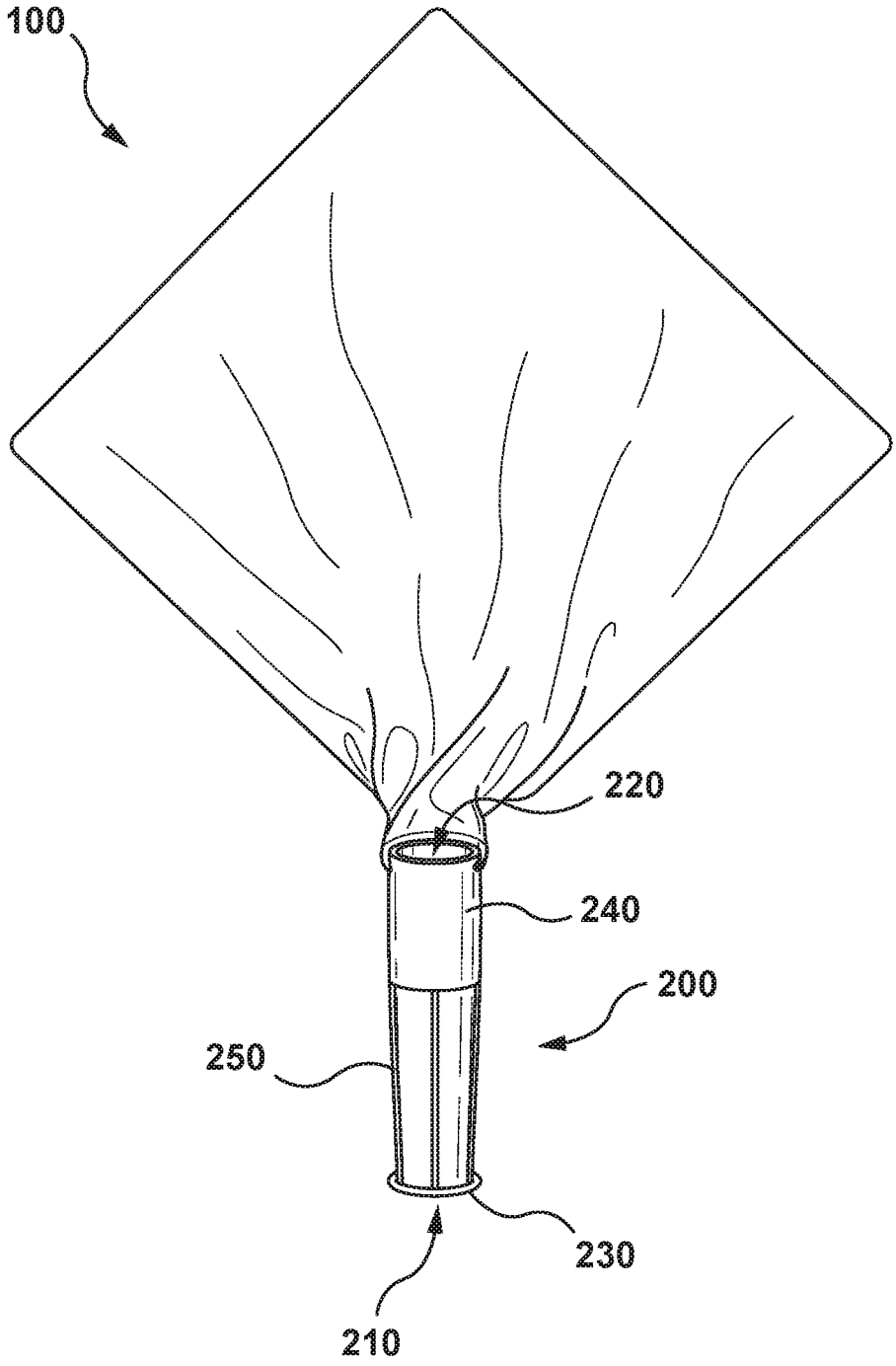
FIG. 3 depicts a training apparatus, according to another non-limiting embodiment.

The fastening portion 200 may also include a harness 240 providing the second opening 220. In some implementations, the harness 240 may comprise a flexible material forming a tube extending away from the ring 230, the end of the tube providing the second opening 220. FIG. 3 depicts another implementation of the training apparatus, in which the harness 240 includes at least two material members 250 connecting the first opening 210 to the second opening 220. The material members 250 connect the ring 230 to the end of the harness 240 opposite the end forming the second opening 220. In further embodiments, the ring 230 can be omitted, and the first opening 210 can be formed by an end of the harness 240 opposite the end forming the second opening 220.

The harness 240 provides the second opening 220 having a diameter larger than the maximum barrel diameter. The second opening 220 may be sized to accommodate any desired subset of sizes of baseball bats 10 (up to and including all bat sizes) such that the barrel 13 may be received through the second opening 220 into the harness 240. In some implementations, the harness 240 may taper from the second opening 220 towards the first opening 210 to complement the shape of the bat 10. The harness 240 may comprise an elastic material configured to stretch to receive the barrel 13. Thus the harness 240 may be suitable for various sizes of bats 10. The elastic material may also provide some anti-slip properties to limit rotational movement of the bat 10 within the harness 240. In other implementations, the harness 240 may further comprise an anti-slip material configured to limit rotational movement of the bat 10 within the harness 240.

As depicted in FIG. 2, to secure the training apparatus to the baseball bat 10, the handle portion 11 is received through the harness 240 and the ring 230, and the barrel 13 is received in the harness 240. Thus, when the ring 230 (i.e. the first opening 210) engages the barrel 13 adjacent the handle portion 11, at least a portion of the barrel 13 is in the harness 240, with the second opening 220 adjacent the barrel end 14. The resistance portion 300 extends past the barrel end 14.

The resistance portion 300 generally comprises a member of flexible material attached to the fastening portion 200 configured to add resistance during a bat swing. The flexible material may have a perimeter 310. For example, the resistance portion 300 may be a cloth or towel-like material, such as a terrycloth, having the perimeter 310. In other implementations, the resistance portion 300 may comprise a lightweight material. The material forming the resistance portion 300 can be selected to limit moisture retention (e.g. For example, a water-resistant or waterproof material may be employed). In other embodiments, where non-water-resistant material is employed, the weight of the material may be selected to limit an amount of moisture that may be absorbed (e.g. to no more than 50% of the dry weight of the resistance portion 300). The material forming the resistance portion 300 may further be selected to have sufficient weight to provide resistance during a bat swing. Specifically, the resistance portion 300 may be configured to provide drag during a bat swing, such as by moving from a contracted state at rest, to an expanded state in response to motion. For example, the resistance portion 300 may be fabricated from materials having weights of between about 200 grams per square meter (GSM) and about 800 GSM. The resistance portion 300 may have an area of about 0.3 square meters, although it is contemplated that a variety of sizes may be employed for the resistance portion 300, depending on the material used and the desired level of resistance to be generated.

The resistance portion 300 may be connected to the fastening portion 200 adjacent the barrel end 14 of the bat 10. Specifically, the resistance portion 300 may be connected at the second opening 220 defined by the harness 240. Further, the resistance portion 300 may be connected to the fastening portion 200 at least a part 310*a* of the perimeter 310. Specifically, the part 310*a* of the perimeter 310 may be connected to the fastening portion 200 at a part of a circumference of the second opening 220, as depicted in FIG. 1. In other embodiments, the part of the perimeter 310 connected to the fastening portion 200 is connected around the entire circumference of the second opening 220. Thus, the resistance portion 300 is configured to extend past the barrel end 14 when the training apparatus 100 is secured to the bat 10, which allows the resistance portion 300 to provide resistance regardless of the direction of the bat swing.

In some implementations, as noted above, the resistance portion 300 may vary in size and material to produce different amounts of drag to accommodate various stages of training.

Figure 4:
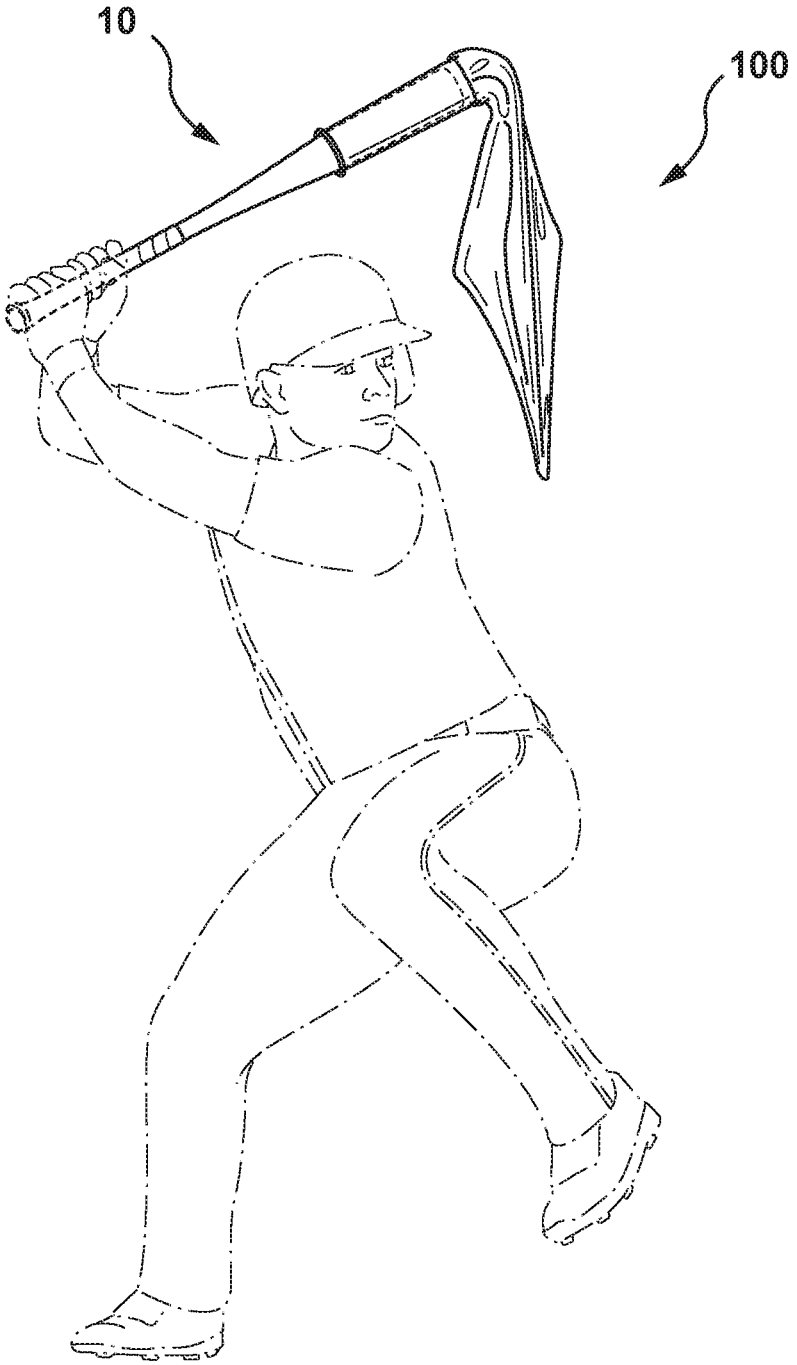
FIG. 4 depicts the training apparatus of FIG. 1 mounted on the bat, held at rest in preparation for a bat swing by a user.

FIG. 4 depicts a user holding a baseball bat 10 with the training apparatus 100 secured to the bat 10. The user is holding the bat 10 and the training apparatus at rest in preparation for a bat swing. In the present example, the resistance portion 300 is in a contracted state while the training apparatus is at rest. Specifically, the resistance portion 300 hangs from the part of the perimeter 310 connected to the second opening 220 at the barrel end 14. The remainder of the perimeter and the flexible material of the resistance portion 300 hang flaccidly.

Figure 5:
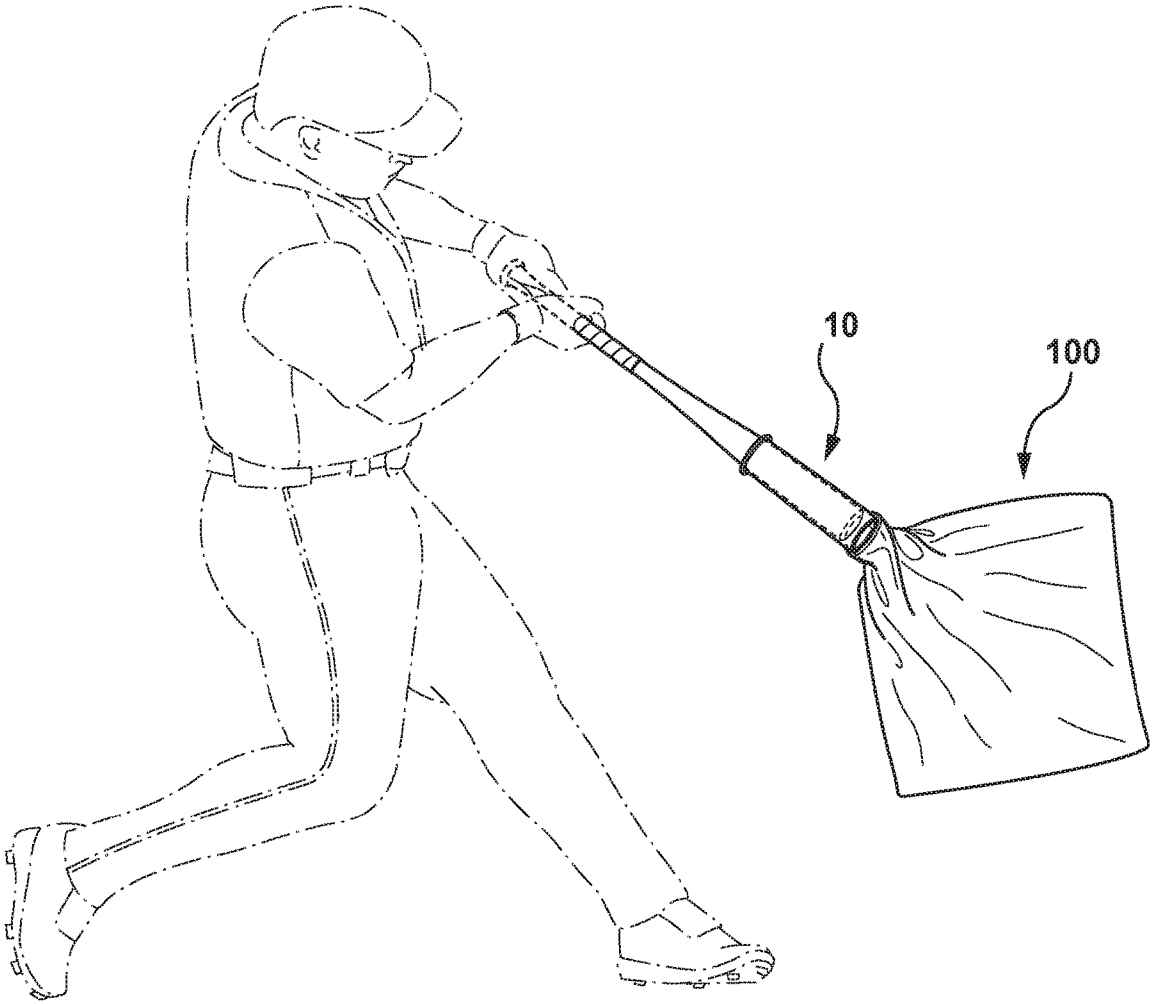
FIG. 5 depicts the training apparatus of FIG. 1 mounted on the bat, during a bat swing by a user.

FIG. 5 depicts the user swinging the baseball bat 10 and the training apparatus 100. In response to the motion of the bat swing, the resistance portion 300 moves from the contracted state to the expanded state. Specifically, as the user swings the bat, the flexible material of the resistance portion 300 interacts with the air to expand towards its fully expanded state. The resistance portion 300 may also be substantially aligned with a longitudinal axis of the bat defined by the knob 12 and the barrel end 14. The amount of expansion may be directly proportional to the speed of the motion. Since the resistance portion 300 has a greater surface area in its expanded state than its contracted state, the resistance portion 300 creates more drag, thereby adding resistance during the bat swing. Further, since the resistance portion 300 moves to its expanded state regardless of the direction of the bat swing, the training apparatus 100 provides resistance through all 6 steps of the bat swing in all directions of the bat swing.

Other variations of the fastening portion 200, such as snaps, Velcro and the like, to releasably secure the training apparatus 100 to the bat 10 are also contemplated.

Persons skilled in the art will appreciate that there are yet more alternative implementations and modifications possible, and that the above examples are only illustrations of one or more implementations. The scope, therefore, is only to be limited by the claims appended hereto.

The invention claimed is:

1. A training apparatus for use with a bat, the training apparatus comprising:

a fastening member releasably securable to a barrel of the bat, the fastening member having (i) a first opening, smaller than a maximum diameter of the barrel, configured to engage the barrel between a barrel end and a handle of the bat, and (ii) a second opening configured for placement adjacent to the barrel end; and a single flexible resistance member with a perimeter, the single flexible resistance member configured to add resistance during a swing of the bat, and the perimeter including (i) a perimeter segment attached to the fastening member adjacent to the second opening, and (ii) a remainder of the perimeter free of attachment such that the single flexible resistance member hangs freely from the second opening adjacent to the barrel end of the bat when the training apparatus is secured to the barrel;

wherein the single flexible resistance member is configured to move from a contracted state when the training apparatus is at rest towards an expanded state in response to the bat swing, thereby adding resistance during the bat swing; and wherein, in the expanded state, a longitudinal axis of the bat traverses the single flexible resistance member.

2. The training apparatus of claim 1 wherein the fastening member includes a rigid ring forming the first opening.

3. The training apparatus of claim 2 wherein the fastening portion includes a flexible tubular sleeve extending from the rigid ring to the second opening.

4. The training apparatus of claim 2 wherein the second opening is larger than the maximum barrel diameter.

5. The training apparatus of claim 3 wherein the flexible tubular sleeve comprises an elastic material configured to stretch to receive the barrel of the bat.

6. The training apparatus of claim 2 wherein the fastening member further comprises:

at least two straps extending from the rigid ring towards the second opening, and a flexible tubular sleeve joined to the straps and defining the second opening.

7. The training apparatus of claim 4 wherein the fastening portion is configured to receive the handle of the bat through the second opening and the first opening such that:

the first opening engages the barrel adjacent to the handle at the first opening; and the second opening is located adjacent the barrel end when engaged.

8. The training apparatus of claim 1, wherein the single flexible resistance member is a substantially rectangular member having four corners;

wherein the perimeter segment coincides with a first one of the corners; and wherein the remainder of the perimeter includes the remaining three corners.

* * * * *